US005820258A

United States Patent [19]

Braun

[11] Patent Number: 5,820,258

[45] Date of Patent: Oct. 13, 1998

[54] CEMENT MIXER DRUM SUPPORT

[75] Inventor: Eric E. Braun, Neenah, Wis.

[73] Assignee: Oshkosh Truck Corporation, Wis.

[21] Appl. No.: 841,933

[22] Filed: Apr. 8, 1997

[51] Int. Cl.[6] ..... B28C 5/42

[52] U.S. Cl. ..... 366/63

[58] Field of Search ..... 366/63, 62, 61, 366/60, 54, 53; 464/92, 113

[56] References Cited

U.S. PATENT DOCUMENTS

| | | | |
|---|---|---|---|
| 3,658,303 | 4/1972 | Funk | 366/62 |
| 3,851,862 | 12/1974 | Mihulowicz | 366/61 |
| 4,378,163 | 3/1983 | Jameson et al. | 366/63 |
| 4,453,830 | 6/1984 | Jameson et al. | 366/63 |
| 4,461,577 | 7/1984 | Mechem | 366/63 |
| 4,575,254 | 3/1986 | Johnston | 366/62 |
| 5,149,126 | 9/1992 | Brennan | 366/62 |

FOREIGN PATENT DOCUMENTS

| | | | |
|---|---|---|---|
| 298069 | 11/1965 | Netherlands | 366/60 |
| 595963 | 2/1978 | Switzerland | 366/63 |

*Primary Examiner*—Tony G. Soohoo
*Attorney, Agent, or Firm*—Foley & Lardner

[57] ABSTRACT

An improved cement-mixing drum support and drive arrangement is disclosed herein. Such an arrangement can be used with a cement-mixing drum of the type incorporated in a self-propelled mobile cement mixer, a stationary cement mixer, or a trailer-supported cement mixer. The drum support provides an axis of rotation for the driven end of the drum, wherein the motor which generates the energy to rotate the drum can move with the driven end of the drum in response to deflections of the drum relative to the structure supporting the drum. In particular, the shaft which supports the driven end of the drum is rotatably supported by a bearing, wherein the bearing is permitted to rotate about an axis perpendicular to the rotational axis of the bearing. This may be provided by using a bearing supported by a universal-type joint. To permit the motor which drives the drum to move freely in response to deflections of the driven end of the drum, the motor is supported by the drum drive shaft and restrained from rotation by the universal-type joint.

33 Claims, 5 Drawing Sheets

CEMENT MIXER DRUM SUPPORT

FIELD OF THE INVENTION

The present invention generally relates to the rotation of the mixing drum for a cement mixer. In particular, the present invention relates to supporting the drum and an associated drive motor to permit movements resulting in the misalignment or deflection of the mixing drum relative to the structure supporting the drum.

BACKGROUND OF THE INVENTION

Typically, cement and the associated aggregates are mixed using a mixing drum of the type including internal paddles which mix the cement and aggregate to provide a generally homogeneous material which is poured and shaped to form a desired concrete structure (e.g., road, building support, foundation, sidewalk, etc.). Normally, these mixing drums are supported on the frame of an associated truck to provide a mobile cement-mixing system. Alternatively, such drums can be rotatably supported on the frame of a towable trailer or supported at a permanent location where the mixed material is transported only a relatively short distance.

One problem which has been encountered with respect to rotatably supporting cement-mixing drums is the inability to fabricate or to support such a drum in a way which permits the driven end of the drum to be rigidly supported by bearings. More specifically, a typical drum may be 15-feet long, 8-feet in diameter, and weigh in the range of 40,000 pounds when carrying a load of cement. Accordingly, when the drum is rotating and the internal paddles are continuously mixing the material therein, the drum is subjected to accelerations of the material. As a result, the drum deflects and causes the shaft or drive assembly at the driven end of the drum to deflect relative to the vehicle or stationary frame which supports the drum. Furthermore, given the size of typical cement mixer drums, it is not economically feasible to fabricate a drum which in either its loaded or unloaded state has a driven end which rotates without deflection.

The problem of drum deflection relative to the frame supporting the drum is exacerbated when the drum and frame are supported on an uneven or rough terrain. For example, mobile cement mixers must frequently travel across extremely rough and uneven terrains to reach a construction site. In addition, the construction site itself is many times rough and uneven. Consecutively, the uneven terrain causes the relatively flexible drum support to deflect relative to the drum. As a result, deflections and misalignment of the drum relative to the frame supporting the drum cannot generally be avoided.

As a result, mixers are typically provided with swivel arrangements that permit deflection of the drum relative to the frame. The energy required to rotate the drum during mixing or otherwise can be applied to the drum in a number of ways, including a hydraulic motor and chain drive, or a hydraulic motor and gear box. Where a gear box is used, the gear box is fixed to the frame and is coupled to the driven end of the drum by the swivel arrangement, including a coupling that permits deflection between the output of the gear box and the driven end of the drum. One of the problems with conventional swivel arrangements is their relatively small misalignment tolerance and their inability to completely prevent adverse forces from being transmitted to the gear box. Typical swivel arrangements allow misalignment up to only six degrees in either direction. As a result, the misalignment tolerance of the swivel arrangement is often exceeded. These forces reduce gear box life and typically reduce the life of gear box output seals which retain lubricant within the gear box to unacceptable periods.

Accordingly, it would be desirable to provide an improved arrangement for rotatably supporting a cement-mixing drum relative to a frame and for applying energy to the drum for purposes of rotation.

SUMMARY OF THE INVENTION

The present invention relates to a material mixer for materials such as a sand, gravel and/or cement mixer. The mixer includes a hollow drum including a wall which defines a generally enclosed material mixing chamber and at least one mixing element extending from the wall within the chamber. The drum has a first end fixed to a support shaft including a first longitudinal axis and a second end including an opening through which material can move from the chamber. A bearing is disposed about the support shaft to support the drive shaft for rotation about the first longitudinal axis, and a bearing support is attached to the bearing to support the bearing relative to a support structure for the drum. The mixer also includes a drum drive motor having a drive shaft with a second longitudinal axis. The drive shaft is coupled to the support shaft, and the drum drive motor is attached to the bearing support such that the orientation of the first and second longitudinal axes remains constant when the motor is operated to rotate the drum to mix material therein.

The present invention also relates to a mobile material mixer. The mixer includes a support structure, and a plurality of wheels rotatably attached to the support structure to movably support the support structure relative to a surface. The mixer also includes a hollow drum having a wall which defines a generally enclosed material mixing chamber and at least one mixing element extending from the wall within the chamber. The drum has a first end fixed to a support shaft including a first longitudinal axis and a second end including an opening through which material can move from the chamber. A bearing is disposed about the support shaft to support the support shaft for rotation about the first longitudinal axis. A bearing support is attached to the support structure and the bearing to support the bearing relative to the support structure. The mixer further includes a drum drive motor including a drive shaft having a second longitudinal axis and a housing mechanically coupled to the support structure to prevent the housing from rotating with the drive shaft, the drive shaft being coupled to the support shaft. The drum drive motor is attached to the bearing support such that the orientation of the first and second longitudinal axes remains constant when the motor is operated to rotate the drum to mix material therein. A movement accommodator attaches the bearing support to the support structure to permit limited movement of the bearing relative to the support structure without subjecting the support shaft to substantially increased bending moments as a result of the limited movement.

The present invention further relates to a self-propelled, mobile material mixer including a support structure, a plurality of wheels rotatably attached to the support structure to movably support the support structure relative to a surface, an engine, and a transmission coupled between the engine and at least one of the wheels to selectively apply power from the engine to the at least one wheel. The mixer also includes a hollow drum having a wall which defines a generally enclosed material mixing chamber and at least one mixing element extending from the wall within the chamber. The drum has a first end fixed to a support shaft including a first longitudinal axis and a second end including an opening through which material can move from the chamber. A bearing is disposed about the support shaft to support the support shaft for rotation about the first longitudinal axis. A bearing support is attached to the support structure and the bearing to support the bearing relative to the support structure. The mixer further includes a drum drive motor including a drive shaft having a second longitudinal axis and a housing mechanically coupled to the support structure to prevent the housing from rotating with the drive shaft, the drive shaft being coupled to the support shaft. The drum drive motor is attached to the bearing support such that the orientation of the first and second longitudinal axes remains constant when the motor is operated to rotate the drum to mix material therein. A movement accommodator attaches the bearing support to the support structure to permit limited movement of the bearing relative to the support structure without subjecting the support shaft to substantially increased bending moments as a result of the limited movement.

BRIEF DESCRIPTION OF THE DRAWINGS

Preferred embodiments of the invention will hereinafter be described in conjunction with the appended drawings, wherein like numerals denote like elements, and:

FIG. 3 is a view taken along lines 3—3 of FIG. 2, illustrating greater detail of the drum support and the movement accommodator;

FIG. 5 is a view taken along lines 5—5 of FIG. 4, showing greater detail of the alternate embodiment of the movement accommodator illustrated in FIG. 4.

DETAILED DESCRIPTION OF THE PREFERRED EMBODIMENT

Figure 1:
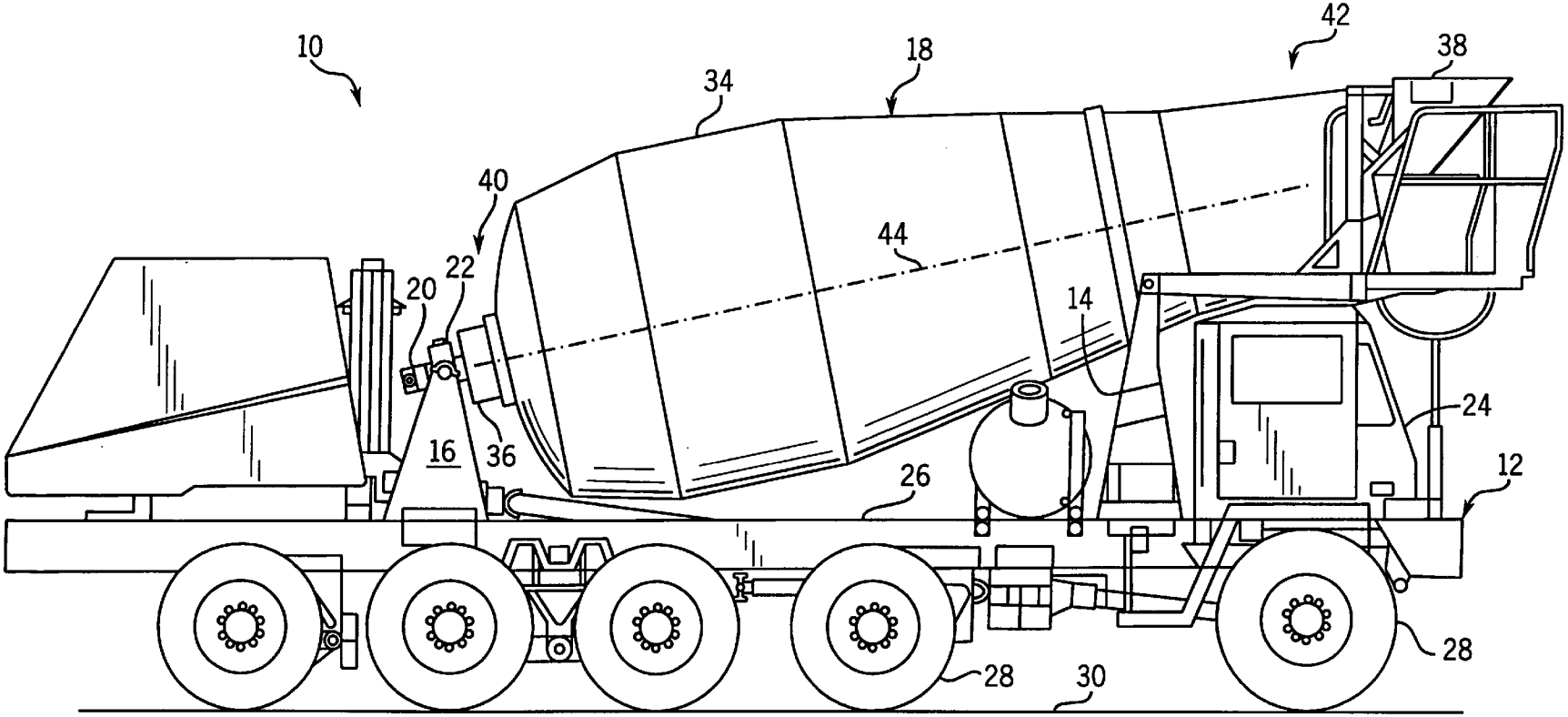
FIG. 1 is a side elevational view of a mobile mixer.

FIG. 1 is a side elevational view of mobile material mixer 10 for mixing, transporting, and dispensing cement and associated aggregate. Mixer 10 generally includes chassis 12, drum supports 14 and 16, drum 18, bearing support 19 (shown in FIG. 2), drum drive 20, and movement accommodator 22. Chassis 12 is conventionally known and includes cab 24, frame 26, and wheels 28. Cab 24 houses an engine, drive train, and vehicle controls of mixer 10. Frame 26 extends rearwardly from cab 24 and provides a base for supporting drum supports 14 and 16, drum 18, bearing support 19, drum drive 20, and movement accommodator 22. Wheels 28 are rotatably mounted to frame 26 to movably support mixer 10 above surface 30. Overall, chassis 12 supports and transports drum 18 between multiple sites. As can be appreciated, chassis 12 may have a variety of alternative configurations, depending upon the configuration of drum supports 14 and 16 and on the size of drum 18. Moreover, although chassis 12 is illustrated as including a cab 24, chassis 12 may alternatively omit cab 24 in those applications where frame 26 is pulled or pushed by an independent ground transportation vehicle.

Drum supports 14 and 16 extend above frame 26 to support drum 18 relative to frame 26. Drum supports 14 and 16 are preferably spaced from one another along frame 26 for supporting drum 18. As can be appreciated, drum supports 14 and 16 may have a variety of alternative configurations, sizes, and shapes, depending upon the particular sizes and configurations of drum 18, drum drive 20, and movement accommodator 22. For example, drum supports 14 and 16 may have a variety of configurations, depending upon whether mixer 10 is a rear discharge mixer, front discharge mixer, a mobile cement mixer, a stationary cement mixer, or a trailer supported cement mixer.

Drum 18 is an elongated, hollow container including a wall that defines a generally enclosed material-mixing chamber 34, a support shaft 36, and a discharge opening 38. As conventionally known, mixing chamber 34 generally includes at least one mixing element that extends interiorly from the wall within chamber 34 and which functions to engage and to mix the cement and the associated aggregate. Support shaft 36 is fixedly coupled to drum 18 at a first end 40. Support shaft 36 is rotatably supported about bearing support 19 and by bearings 46 (shown in FIG. 2) for rotation of drum 18 about longitudinal axis 44. Discharge opening 38 provides communication with the interior of drum 18 and is defined at a second end 42. Once the cement and the associated aggregate are sufficiently mixed, the mixture may be discharged through discharge opening 38. Although discharge opening 38 is illustrated at second end 42 of drum 18, discharge opening 38 may alternatively be defined at any one of a variety of locations along drum 18 so as to provide communication with the interior of drum 18.

Drum drive 20 is coupled between drum support 16 and support shaft 36. Drum drive 20 rotatably drives support shaft 36 and drum 18 about longitudinal axis 44. Drum drive 20 and support shaft 36 are movably supported relative to drum support 16 by movement accommodator 22.

Movement accommodator 22 is coupled between drum support 16 and drum 18. Movement accommodator 22 permits limited movement of longitudinal axis 44 of drum 18 relative to drum support 16, without subjecting support shaft 36 to substantially increased bending moments as a result of the limited movement. At the same time, movement accommodator 22 mechanically couples drum drive 20 to drum support 16 to prevent drum drive 20 from rotating with the rotation of drum 18. Although movement accommodator 22 is illustrated for use with a front discharge mixer, movement accommodator may also be utilized in rear discharge mixers as well.

Figure 2:
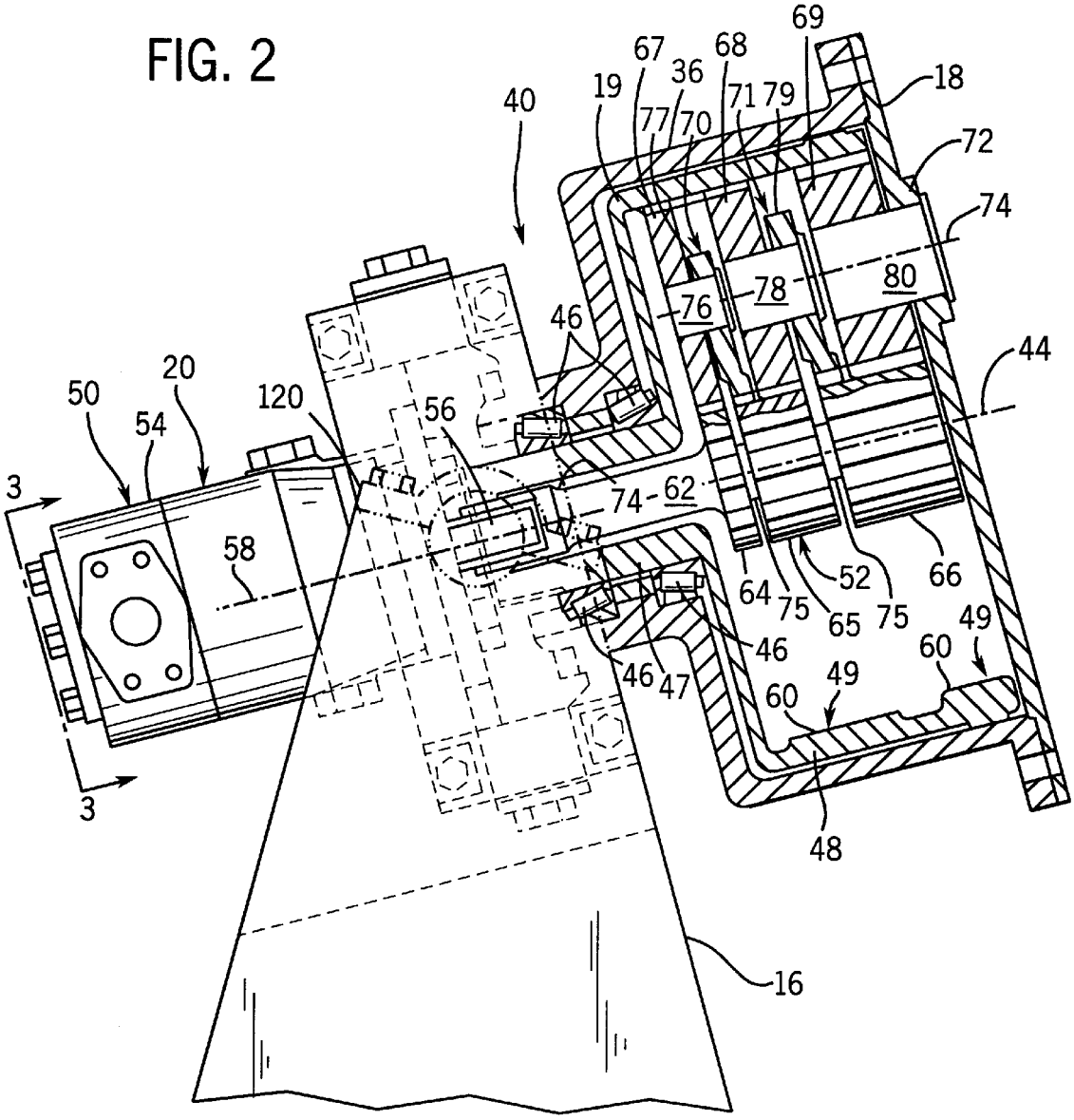
FIG. 2 is an enlarged, fragmentary sectional view of the driven end of the mobile mixer illustrated in FIG. 1, including bearing support, bearings, and drum drive.

FIG. 2 is an enlarged, fragmentary sectional view of end 40 of mixer 10, illustrating bearing support 19, bearings 46, and drum drive 20 in greater detail. As best shown by FIG. 2, bearing support 19 is an elongated, rigid support member or frame extending from motor 50 and drum support 16 towards drum 18. In the preferred embodiment illustrated, bearing support 19 is a generally hollow support member having a first narrow diameter portion 47 and a second enlarged diameter portion 48. Narrow diameter portion 47 of bearing support 19 is fixedly coupled to motor 50 and movement accommodator 22. Narrow diameter portion 47 supports bearings 46 which, in turn, rotatably support support shaft 36. Enlarged diameter portion 48 extends from narrow diameter portion 47 towards drum 18 and widens to define a hollow cavity 49 for the reception of drum drive 20.

Drum drive 20 generally includes motor 50 and gear reduction unit 52. In the preferred embodiment illustrated, motor 50 is a conventionally known hydraulic motor assembly. As can be appreciated, motor 50 may comprise any one of a variety of well-known motors, including electric motors. Motor 50 drives gear reduction unit 52 and includes housing 54 and drive shaft 56. Housing 54 rotatably supports drive shaft 56 in a conventionally known manner. In the preferred embodiment illustrated, housing 54 is fixedly coupled to bearing support 19. Drive shaft 56 extends from motor 50 and is coupled to gear reduction unit 52, whereby it transmits torque to gear reduction unit 52 from motor 50. In the preferred embodiment illustrated, drive shaft 56 is driven about axis 58 by motor 50. Axis 58 extends generally coincident with axis 44 of support shaft 36 and drum 18. Because drive shaft 56 is directly connected to gear reduction unit 52, axis 58 of drive shaft 56 is concentrically aligned with axis 44 of support shaft 36 and drum 18. Alternatively, torque from drive shaft 56 may be transmitted to gear reduction unit 52 by other conventional torque-transmitting mechanisms, such as, belts, chains, or gears, extending between drive shaft 56 and gear reduction unit 52. In such an alternative embodiment, the axis 58 of drive shaft 56 and the axis 44 of drum 18 would eccentrically extend parallel to one another. Furthermore, torque may alternatively be transmitted from gear reduction unit 52 by other conventional torque-transmitting mechanisms, such as, bevel gears, wherein axis 58 of drive shaft 56 is oblique to axis 44 of support shaft 36 and drum 18. In each of the above embodiments, the orientations of axes 44 and 58 are maintained constant relative to one another as motor 50 drives drive shaft 56 to transmit torque to gear reduction unit 52.

Gear reduction unit 52, otherwise known as a speed reducer, receives and transmits torque from motor 50 to support shaft 36 so as to rotate support shaft 36 and drum 18 about axis 44. In the preferred embodiment illustrated, gear reduction unit 52 preferably comprises a conventional epicyclic gear train. In particular, gear reduction unit 52 comprises a three-stage planet gear arrangement for producing a 140 to 1 speed reduction. Gear reduction unit 52 includes annular gear 60, pinion shaft 62, sun gears 64, 65, 66, planet gears 67, 68, 69, and planet carriers 70, 71, and 72. Annular gear 60 is a generally conventionally known, annular-shaped ring gear having an inner circumferential surface with teeth for engaging outer circumferential teeth of planet gears 67, 68, and 69. In the preferred embodiment illustrated, annular gear 60 is integrally formed along an inner circumferential surface of bearing support 19. Alternatively, annular gear 60 may be independently formed and fixedly coupled to bearing support 19. Because bearing support 19 is generally held stationary relative to axis 44, annular gear 60 is also held stationary relative to axis 44. Because annular gear 60 is held stationary, planet gears 67, 68, and 69 rotate about the entire circumferential surface of annular gear 60 so as to transmit torque from pinion shaft 62 to drum 18.

Pinion shaft 62 concentrically extends through bearing support 19 and support shaft 36. Pinion shaft 62 has a first end fixedly coupled to drive shaft 56 for transmitting torque from drive shaft 56 of motor 50 to sun gear 64. Pinion shaft 62 is fixedly coupled to sun gear 64. At the same time, pinion shaft 62 rotatably supports sun gears 65 and 66.

Sun gear 64 is conventionally known and is fixedly coupled to pinion shaft 62. Sun gear 64 includes teeth for engagement with complementary teeth of planet gear 67. As a result, sun gear 64 engages planet gear 67 to rotate planet gear 67.

Planet gear 67 is a generally circular gear including outer circumferential teeth which inter-engage complementary teeth of sun gear 64 and of annular gear 60. Planet gear 67 is rotatably supported by planet carrier 70. As a result, rotation of sun gear 64 by pinion shaft 62 and by drive shaft 56 also rotates planet gear 67 about axis 74 of planet carrier 70. As an integrally formed part of bearing support 19, annular gear 60 is held generally stationary. As a result, rotation of planet gear 67 about axis 74 occurs about the inner circumferential surface of annular gear 60. As planet gear 67 rotates about the inner circumferential surface of annular gear 60, planet gear 67 walks planet carrier 70 about axis 44 at a reduced speed.

Planet carrier 70 extends between planet gear 67 and sun gear 65. Planet carrier 70 generally includes hub 76 and arm 77. Hub 76 is fixedly coupled to arm 77 and concentrically extends through planet gear 67 to rotatably support planet gear 67 between sun gear 64 and annular gear 60. Arm 77 is fixedly coupled to hub 76 and includes teeth for engagement with complementary teeth of sun gear 65. As a result, rotation of planet carrier 70 about axis 44 by planet gear 67 rotates sun gear 65 about pinion shaft 62 at a reduced speed relative to sun gear 64.

Sun gear 65 preferably floats about axis 44 and includes axial extensions 75. Axial extensions 75 project from opposite sides of sun gear 65 to axially locate gear 65. Sun gear 65 further includes outer circumferential teeth for engagement with complementary outer circumferential teeth of planet gear 68. Rotation of sun gear 65 rotates planet gear 68 about axis 74 of planet carrier 71.

Planet gear 68 is a generally circumferential gear including outer circumferential teeth for inter-engagement with complementary teeth of both sun gear 65 and of annular gear 60. Planet gear 68 is rotatably supported about axis 74 by planet carrier 71. Because annular gear 60 is held stationary, sun gear 65 causes planet gear 68 to rotate about the inner circumferential surface of annular gear 60. The rotation of planet gear 68 about the inner circumferential surface of annular gear 60 walks planet carrier 71 about axis 44 of pinion shaft 62.

Planet carrier 71 is similar to planet carrier 70 and includes hub 78 and arm 79. Hub 78 is fixedly coupled to arm 79 and extends through planet gear 68 to rotatably support planet gear 68 about axis 74. Arm 79 extends from hub 78 and includes teeth for engagement with complementary teeth of sun gear 66. As a result, rotation of planet carrier 71 about axis 44 by pinion gear 68 rotatably drives sun gear 66 about axis 44 at a reduced speed relative to sun gear 65.

Sun gear 66 is a conventionally known sun gear that includes outer circumferential teeth for engagement with complementary teeth of planet gear 69. Rotation of sun gear 66 by planet carrier 71 rotatably drives planet gear 69 about axis 74 of planet carrier 72.

Planet gear 69 is a generally circular gear including outer circumferential teeth for inter-engagement with complementary teeth of both sun gear 66 and of annular gear 60. Planet gear 69 is rotatably supported by planet carrier 72. Unlike planet carriers 70 and 71, planet carrier 72 generally comprises a hub 80 extending through planet gear 69 for rotatably supporting planet gear 69 about axis 74. Hub 80 is fixedly coupled to drum 18. As a result, rotation of planet carrier 72 about axis 44 by planet gear 69 also rotates drum 18 about axis 44 at a reduced speed relative to sun gear 66.

Because annular gear 60 is held stationary, sun gear 66 causes planet gear 69 to rotate about the inner circumferential surface of annular gear 60. Consequently, the rotation of planet gear 69 then causes planet gear 72 to rotate about axis 44 of pinion shaft 62. As a result, higher torque is transmitted at a reduced speed from pinion shaft 62 to drum 18.

For ease of illustration, only a single set of planet gears and planet carriers between annular gear 60 and sun gear 64, 65, and 66 has been illustrated. However, in the preferred embodiment, gear reduction unit 52 preferably includes three such sets of planet gears and sun gears circumferentially spaced at 120 degrees about axis 44 between annular gear 60 and sun gears 64, 65, and 66. As can be appreciated, gear reduction unit 52 may have a variety of alternative sizes, shapes, and configurations. For example, in lieu of planet carriers 70 and 71 being fixedly coupled relative to sun gears 65 and 66 by inter-engaged teeth, planet carriers 70 and 71 may alternatively be fixedly coupled relative to sun gears 65 and 66, respectively, by various other mechanisms, such as, by bolting, by welding, or by integral formation as a unitary body. Moreover, in lieu of the particular configuration shown, gear reduction unit 52 may alternatively consist of any one of a variety of well-known epicyclic gearing arrangements. Overall, gear reduction unit 52 receives torque from drive shaft 56 of motor 50 and transmits the torque to support shaft 36 and to drum 18 at a lower speed. Gear reduction unit 52 enables a smaller, more compact, and less expensive motor 50 to be utilized for rotating drum 18. As can be appreciated, gear reduction unit 52 may have a variety of alternative sizes, shapes, and configurations, depending upon the sizes and configurations of motor 50 and drum 18.

Figure 3:
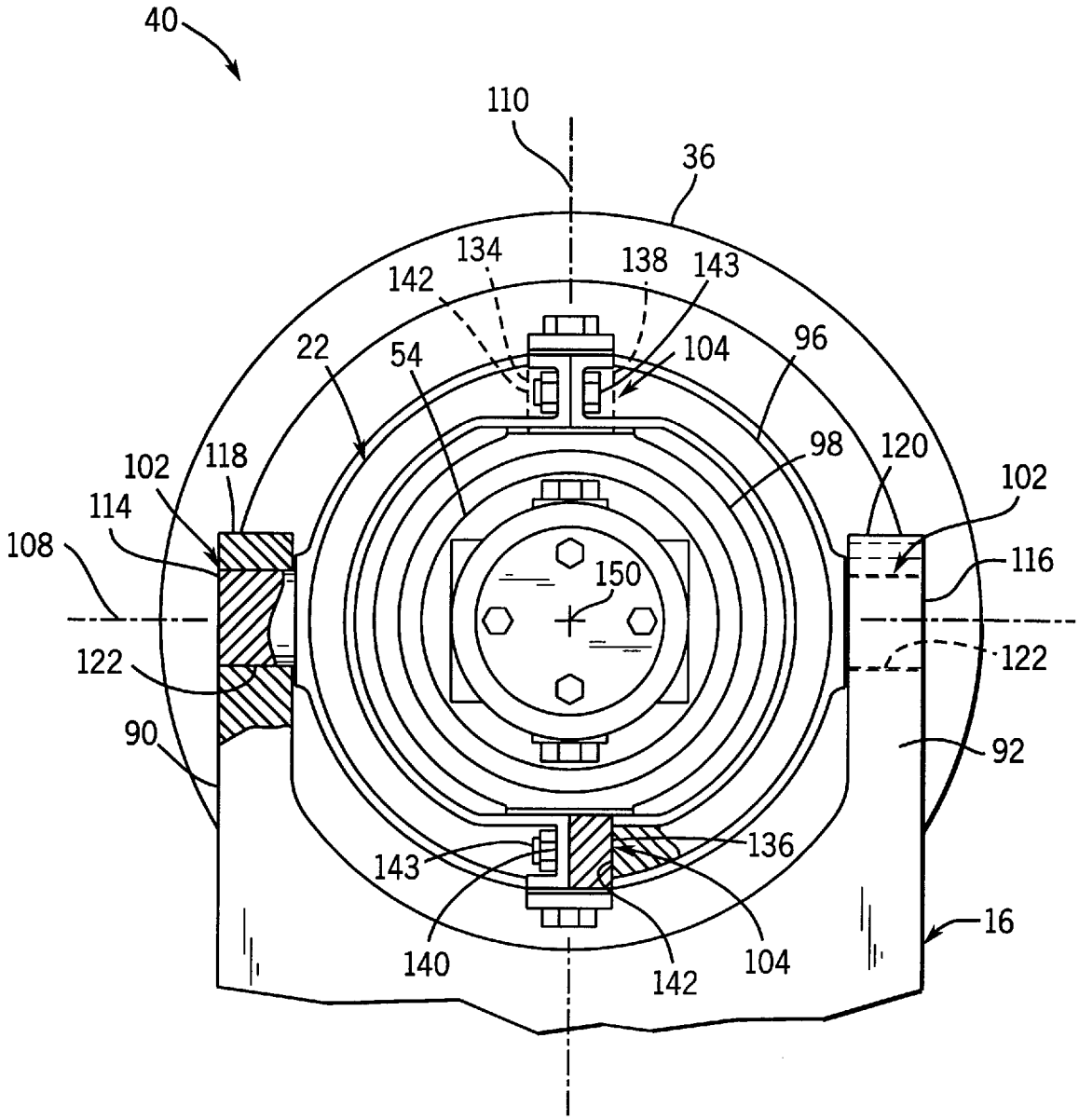
FIG. 3 is a fragmentary elevational view of the driven end of the mobile mixer illustrated in FIG. 2. Particularly.

FIG. 3 is a fragmentary elevational view of first end 40 of mixer 10 taken along lines 3—3 of FIG. 2. FIG. 3 illustrates drum support 16 and movement accommodator 22 in greater detail. As best shown by FIG. 3, drum support 16 includes a pair of bifurcated arms 90 and 92 for supporting movement accommodator 22. Arms 90 and 92 of drum support 16 support movement accommodator 22, motor 50, and drum 18 above frame 26 of chassis 12 (shown in FIG. 1).

Movement accommodator 22 couples bearing support 19 and motor 50 to drum support 16 to permit limited movement of bearing support 19 and bearings 46 relative to drum support 16, without subjecting support shaft 36 to substantially increased bending moments as a result of the limited movement. At the same time, movement accommodator 22 mechanically couples housing 54 of motor 50 and bearing support 19 to drum support 16, thereby preventing rotation of housing 54 and bearing support 19 with the rotation of drum 18. Movement accommodator 22 generally includes carriers 96 and 98 and pivot assemblies 102 and 104. Carrier 96 is coupled between drum support 16 and carrier 98. Carrier 96 is preferably configured to pivot or to rotate relative to arms 90 and 92 of drum support 16 about axis 108. In addition, carrier 96 is preferably configured and supported so as to enable carrier 98 to pivot or to rotate relative to carrier 96 about axis 110. In the preferred embodiment illustrated in FIG. 3, carrier 96 is generally annular in shape and is sized so as to pivotably mount between bifurcated arms 90 and 92 of drum support 16 and so as to encircle carrier 98. Carrier 96 is pivotably coupled to arms 90 and 92 of drum support 16 by pivot assembly 102.

Pivot assembly 102 pivotably interconnects carrier 96 to drum support 16 to permit rotation of carrier 96 about axis 108. Pivot assembly 102 includes pivot shafts 114 and 116 and journal supports 118 and 120. Pivot shafts 114 and 116 are fixedly coupled or integrally formed with carrier 96 and oppositely extend away from carrier 96 through journal supports 118 and 120, respectively. Journal supports 118 and 120 define bores 122 sized for the reception of pivot shafts 114 and 116. Bores 122 form bearing surfaces against which pivot shafts 114 and 116 of carrier 96 rotate about axis 108. As shown by FIG. 2, journal support 120 is preferably formed by bolting two adjacent ends, such as, bearing caps having semicylindrical surfaces, together to define bores 122. Journal support 118 is substantially identical to journal support 120. As a result, pivot shafts 114 and 116 may be easily mounted within bores 122 of journal supports 118 and 120 during assembly. Alternatively, pivot assembly 102 may include other well-known bearing mechanisms for enabling carrier 96 to pivot relative to drum support 16 about axis 108. Such well-known bearing mechanisms may include bushings, ball bearings, and the like.

Carrier 98 is coupled between carrier 96 and housing 54 of motor 50. In the preferred embodiment illustrated, carrier 98 encircles and is fixedly coupled to a portion of housing 54 of motor 50. At the same time, carrier 98 is pivotably coupled to carrier 96 for rotation about axis 110. Carrier 98 is configured and positioned for rotation about axis 110 through carrier 96. Carrier 98 is pivotably supported relative to carrier 96 by pivot assembly 104.

Pivot assembly 104 pivotably couples carrier 98 to carrier 96 about axis 110 and includes pivot shafts 134 and 136 and journal supports 138 and 140. Pivot shafts 134 and 136 are fixedly coupled to or integrally formed with carrier 98 and oppositely extend from carrier 98 concentrically about axis 110. Pivot shafts 134 and 136 extend through journal supports 138 and 140, respectively, to enable carrier 98 to pivot relative to carrier 96 about axis 110.

Journal supports 138 and 140 are preferably integrally formed as part of carrier 96 and define cylindrical bores 142. Cylindrical bores 142 have bearing surfaces upon which pivot shafts 134 and 136 rotate. In the preferred embodiment illustrated in FIG. 3, carrier 96 is formed from two identical C-shaped halves which are joined end-to-end by bolt assemblies 143. The mating ends of the C-shaped carrier halves define opposing concave, semicylindrical surfaces which, when joined together, form bores 142 of journal supports 138 and 140. As can be appreciated, bores 142 of journal supports 138 and 140 may be formed by a variety of alternative methods, such as, drilling aligned bores through opposite ends of an integrally formed carrier 96. Furthermore, although pivot assembly 104 is illustrated as including journal supports 138 and 140 for rotatably supporting pivot shafts 134 and 136, pivot assembly 104 may alternatively comprise any one of a variety of well-known bearing mechanisms for enabling carrier 98 to pivot relative to carrier 96 about axis 110.

Carrier 98 is fixedly coupled to housing 54 of motor 50. Similarly, motor 50 is also fixedly coupled to bearing support 19, as shown in FIG. 2. Therefore, as a result of this coupling sequence, carrier 98 permits limited rotation of bearing support 19, bearings 46, support shaft 36, drum 18, and motor 50 about axis 110 relative to carrier 96 and to drum support 16. Carrier 96 not only supports carrier 98, but it is also pivotably coupled to drum support 16 about axis 108. Consequently, carrier 96 additionally enables limited movement of motor 50, bearing support 19, bearings 46, support shaft 36, and drum 18 about axis 108 relative to drum support 16. As a result, movement accommodator 22 enables first end 40 of drum 18 to oscillate about axes 108 and 110 during rotation of drum 18, without subjecting motor 50, bearing support 19, bearings 46, or support shaft 36 to large bending moments. At the same time, movement accommodator 22 mechanically couples housing 54 of motor 50 to drum support 16. This coupling prevents housing 54 of motor 50 from rotating about axis 150, thereby enabling motor 50 to rotate drum 18. Consequently, movement accommodator 22 increases the misalignment tolerance between the drum and the drum support. In the preferred embodiment illustrated, movement accommodator 22 allows misalignment of at least up to ten degrees in either direction. As a result, gear box life is increased, while allowing the use of conventional oil seals on the gearbox.

Figure 4:
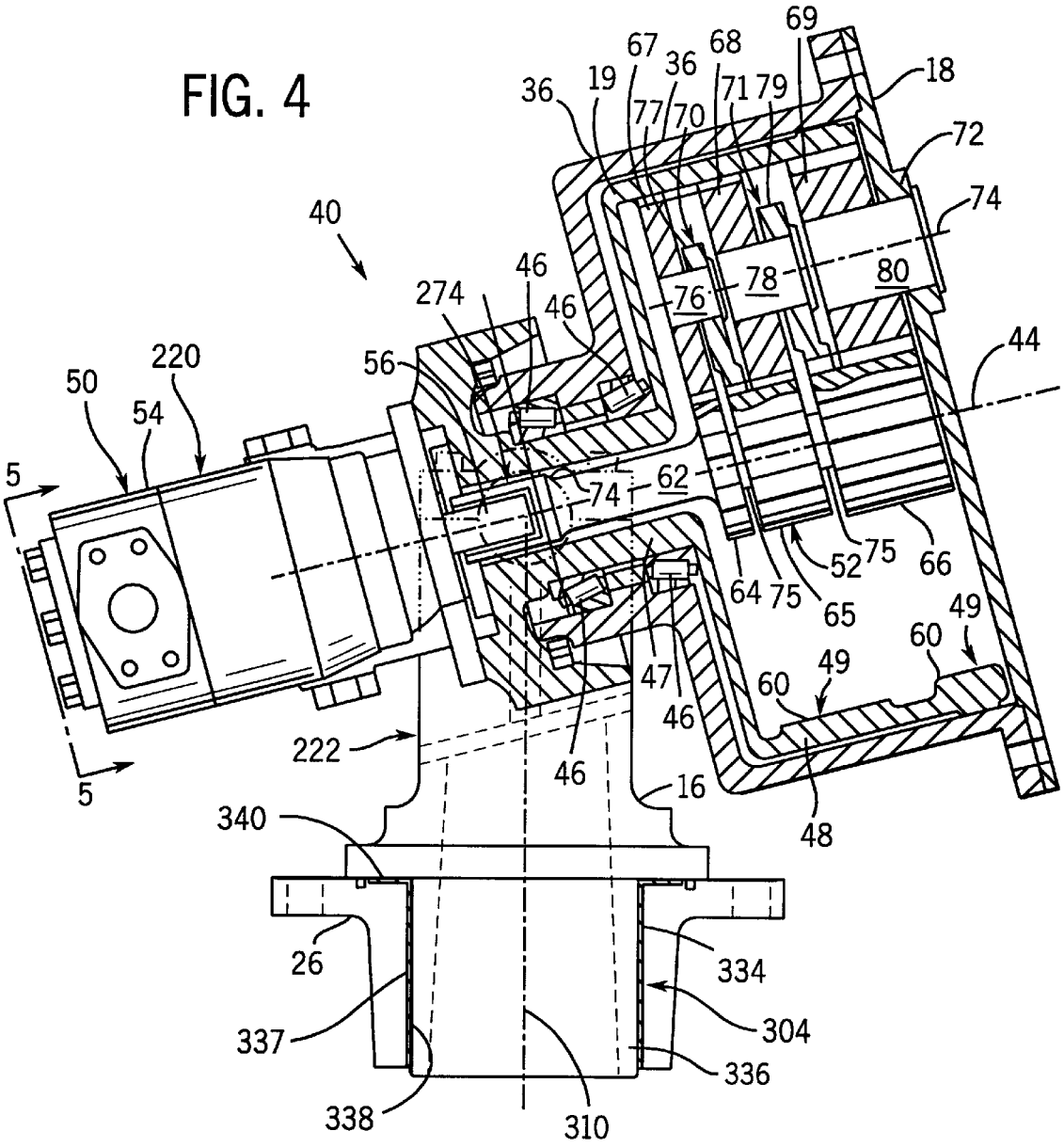
FIG. 4 is an enlarged, fragmentary side elevational view of the driven end of the mobile mixer illustrated in FIG. 2, featuring an alternate embodiment of the movement accommodator illustrated in FIG. 3.
Figure 5:
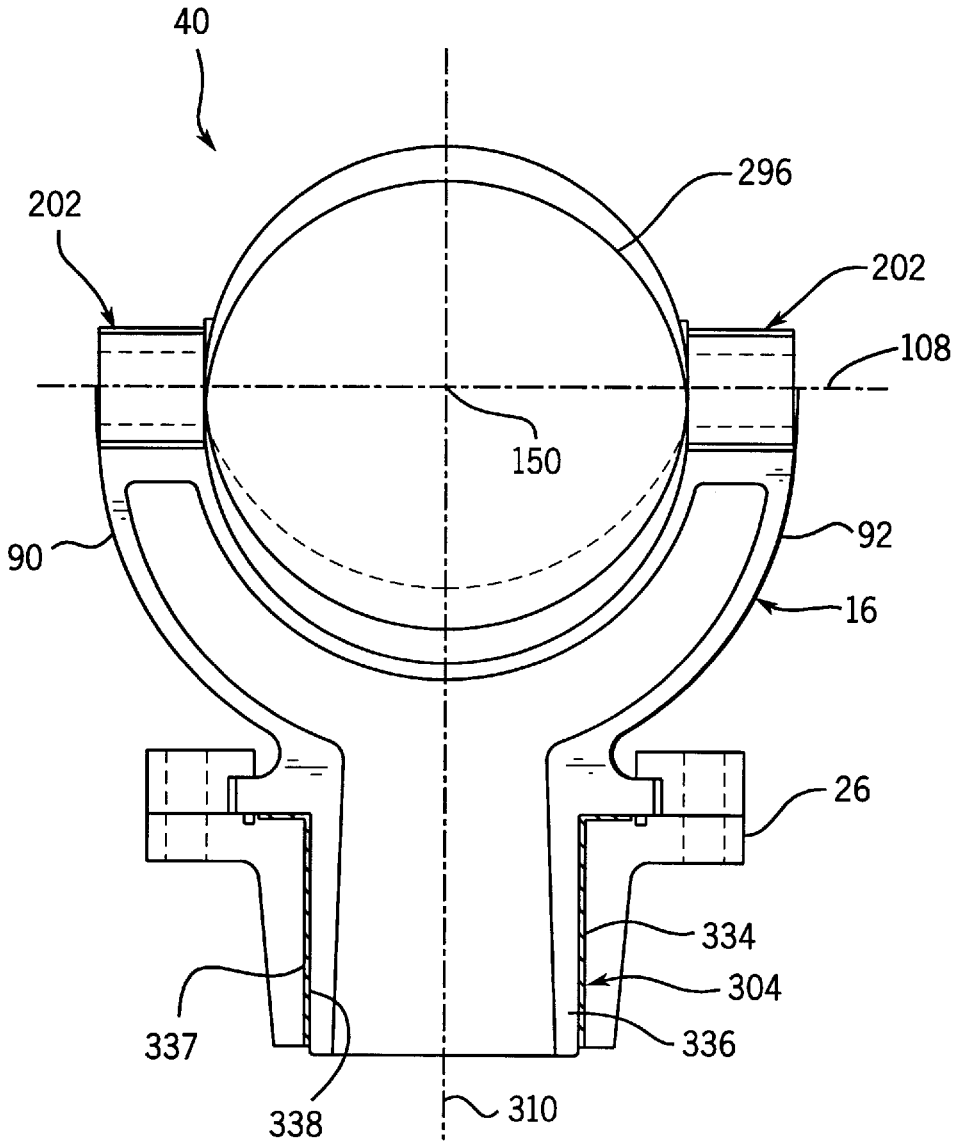
FIG. 5 is a schematic, fragmentary elevational view of the driven end of the mobile mixer illustrated in FIG. 2. Particularly.

FIGS. 4 and 5 illustrate end 40 of mixer 10, including movement accommodator 222, an alternate embodiment of movement accommodator 22. FIG. 5 is a schematic, fragmentary elevational view taken along lines 5—5 of FIG. 4, illustrating movement accommodator 222 in greater detail. Movement accommodator 222 is similar to movement accommodator 22, except that movement accommodator 222 includes pivot mechanism 304 in lieu of carrier 98 and of pivot assembly 104. Pivot 304 movably mounts drum support 16 relative to frame 26 and includes bearing 334, pivot shaft 336, and liner 340. Bearing 334 preferably comprises a sleeve of bore 337 formed within frame 26 below drum support 16 and lined with a liner 338 which serves as a bearing surface for pivot shaft 336. Bearing 334 preferably accommodates rotation of pivot shaft 336 through a range of at least twenty degrees.

Liner 340 extends about bore 337 between drum support 16 and a top surface of frame 26. Liner 340 and liner 338 enable drum support 16 and pivot shaft 336 to rotate relative to frame 26 about axis 310. In the preferred embodiment illustrated, liner 338 and liner 340 are preferably formed from a low friction material, such as, acetal or TEFLON. As can be appreciated, liner 338 and liner 340 may be formed from a variety of alternative materials suitable for enabling pivot shaft 336 and drum support 16 to rotate relative to frame 26 about axis 310. Alternatively, liners 338 and 340 may be replaced with other conventional bearing means, such as, bushings, ball bearings, and the like.

FIG. 5 is a schematic, fragmentary elevational view of end 40 of mixer 10 taken along lines 5—5 of FIG. 4. As best shown by FIG. 5, carrier 296 is pivotably coupled to arms 90 and 92 of drum support 16 by pivot assembly 202. Pivot assembly 202 is substantially identical to pivot assembly 102 utilized with movement accommodator 22. Pivot assembly 202 pivotably supports carrier 296 relative to drum support 16 about axis 108. Carrier 296 is itself fixedly coupled to housing 54 of motor 50 (shown in FIG. 4). As a result, carrier 296 enables bearing support 19, bearings 46, motor 50, and drum 18 to rotate or to pivot relative to drum support 16 and to frame 26 about axis 108.

At the same time, pivot mechanism 304 enables bearing support 19, bearings 46, support shaft 36, motor 50, and drum 18, which are all coupled to drum support 16, to rotate or to pivot about axis 310 relative to frame 26. Similar to movement accommodator 22, movement accommodator 222, incorporating pivot mechanisms 202 and 304, enables bearing support 19, bearings 46, support shaft 36, and drum 18 to oscillate during rotation of drum 18. However, bearing support 19, bearings 46, or support shaft 36 are not subjected to substantial bending moments as a result of the oscillation. In addition, carrier 296 and pivot assembly 202 mechanically couple motor 50 to drum support 16. Such coupling prevents rotation of motor 50 about axis 150, thereby allowing motor 50 to rotate drum 18.

It is understood that, while the detailed drawings and specific examples describe the exemplary embodiments in the present invention, they are there for the purpose of illustration only. The apparatus and method of invention is not limited to the precise details, geometries, dimensions, materials, and conditions disclosed. Various changes can be made to the precise details discussed without departing from the spirit of the invention which is defined by the following claims.

What is claimed is:

1. A material mixer comprising:

a support structure;

a hollow drum including a wall which defines a generally enclosed material mixing chamber and at least one mixing element extending from the wall within the chamber, the drum having a first end fixed to a support shaft including a first longitudinal axis and a second end including an opening through which material can move from the chamber;

a bearing disposed about the support shaft to support the support shaft for rotation about the first longitudinal axis;

a drum drive motor including a drive shaft having a second longitudinal axis, the drive shaft being coupled to the support shaft; and a movement accommodator including:

a first carrier pivotally coupled to the support structure on first opposite sides of the first longitudinal axis; and a second carrier fixedly coupled to the bearing and pivotally coupled to the first carrier on second opposite sides of the first longitudinal axis to pivotally support the bearing, the support shaft and the drive shaft such that the relative orientation of the first and second longitudinal axes remains constant when the motor is operated to rotate the drum to mix material therein.

2. The mixer of claim 1, wherein the drum drive motor includes a housing, and the housing is mechanically coupled to the support structure to prevent the housing from rotating with the drive shaft.

3. The mixer of claim 2, further comprising a gear drive coupled between the support shaft and drive shaft to transfer torque between the shafts.

4. The mixer of claim 3, wherein the drum drive motor is a hydraulic motor.

5. The mixer of claim 2, wherein the longitudinal axes of the support and drive shafts are coincident.

6. The mixer of claim 1 wherein the support structure is fixed against rotation.

7. The mixer of claim 1 wherein the first carrier pivots about a substantially horizontal axes.

8. The mixer of claim 1 wherein the second carrier pivots about a substantially vertical axes.

9. The mixer of claim 1 wherein the first carrier encircles the second carrier.

10. The mixer of claim 1 wherein the first carrier includes:

a first C-shaped member pivotally coupled to the support structure on a first side of the first longitudinal axis; and a second opposite C-shaped member pivotally coupled to the support structure on a second opposite side of the first longitudinal axis, wherein the first and second C-shaped members have ends coupled to one another and pivotally supporting the second carrier.

11. The mixer of claim 1 wherein the first carrier and the second carrier concentrically extend about the first longitudinal axis.

12. The mixer of claim 1 wherein the support structure supports the first carrier and the second carrier about the first longitudinal axis.

13. A mobile material mixer comprising:

a support structure;

a plurality of wheels rotatably attached to the support structure to movably support the support structure relative to a surface;

a hollow drum including a wall which defines a generally enclosed material mixing chamber and at least one mixing element extending from the wall within the chamber, the drum having a first end fixed to a support shaft including a first longitudinal axis and a second end including an opening through which material can move from the chamber;

a bearing disposed about the support shaft to support the support shaft for rotation about the first longitudinal axis;

a drum drive motor including a drive shaft having a second longitudinal axis and a housing mechanically coupled to the support structure to prevent the housing from rotating with the drive shaft, the drive shaft being coupled to the support shaft; and a movement accommodator which attaches the bearing support to the support structure to permit limited movement of the bearing relative to the support structure, without subjecting the support shaft to substantially increased bending moments as a result of the limited movement, the movement accommodator including:

a first carrier pivotally coupled to the support structure on first opposite sides of the first longitudinal axis; and a second carrier fixedly coupled to the bearing and pivotally coupled to the first carrier on second opposite sides of the first longitudinal axis to pivotally support the bearing, the support shaft and the drive shaft such that the orientation of the first and second longitudinal axes remains constant when the motor is operated to rotate the drum to mix material therein.

14. The mixer of claim 13, further comprising a gear drive coupled between the support shaft and drive shaft to transfer torque between the shafts.

15. The mixer of claim 14, wherein the drum drive motor is a hydraulic motor.

16. The mixer of claim 15, wherein the longitudinal axes of the support and drive shafts are coincident.

17. The mixer of claim 13 wherein the support structure is fixed against rotation.

18. The mixer of claim 13 wherein the first carrier pivots about a substantially horizontal axes.

19. The mixer of claim 13 wherein the second carrier pivots about a substantially vertical axes.

20. The mixer of claim 13 wherein the first carrier encircles the second carrier.

21. The mixer of claim 13 wherein the first carrier includes:

a first C-shaped member pivotally coupled to the support structure on a first side of the first longitudinal axis; and a second opposite C-shaped member pivotally coupled to the support structure on a second opposite side of the first longitudinal axis, wherein the first and second C-shaped members have ends coupled to one another and pivotally supporting the second carrier.

22. The mixer of claim 13 wherein the first carrier and the second carrier concentrically extend about the first longitudinal axis.

23. The mixer of claim 13 wherein the support structure supports the first carrier and the second carrier about the first longitudinal axis.

24. A self-propelled, mobile material mixer comprising:

a frame;

a support structure fixed to the frame and extending above the frame;

a plurality of wheels rotatably attached to the frame to movably support the frame relative to a surface;

an engine;

a transmission coupled between the engine and at least one of the wheels to selectively apply power from the engine to the at least one wheel;

a hollow drum including a wall which defines a generally enclosed material mixing chamber and at least one mixing element extending from the wall within the chamber, the drum having a first end fixed to a support shaft including a first longitudinal axis and a second end including an opening through which material move from the chamber;

a bearing disposed about the support shaft to support the support shaft for rotation about the first longitudinal axis;

a bearing support attached to the bearing to support the bearing relative to the support shaft;

a drum drive motor including a drive shaft having a second longitudinal axis and a housing mechanically coupled to the support structure to prevent the housing from rotating with the drive shaft, the drive shaft being coupled to the support shaft; and a movement accommodator which attaches the bearing support to the support structure above the frame to permit limited movement of the bearing relative to the support structure, without subjecting the support shaft to substantially increased bending moments as a result of the limited movement, the movement accommodator including:

a first carrier pivotally coupled to the support structure on first opposite sides of the first longitudinal axis; and a second carrier fixedly coupled to the bearing and pivotally coupled to the first carrier on second opposite sides of the first longitudinal axis to pivotally support the bearing, the support shaft and the drive shaft such that the orientation of the first and second longitudinal axes remains constant when the motor is operated to rotate the drum to mix material therein.

25. The mixer of claim 24, further comprising a gear drive coupled between the support shaft and drive shaft to transfer torque between the shafts.

26. The mixer of claim 25, wherein the drum drive motor is a hydraulic motor.

27. The mixer of claim 26, wherein the longitudinal axes of the support and drive shafts are coincident.

28. The mixer of claim 24 wherein the first carrier pivots about a substantially horizontal axes.

29. The mixer of claim 24 wherein the second carrier pivots about a substantially vertical axes.

30. The mixer of claim 24 wherein the first carrier encircles the second carrier.

31. The mixer of claim 24 wherein the first carrier includes:

a first C-shaped member pivotally coupled to the support structure on a first side of the first longitudinal axis; and a second opposite C-shaped member pivotally coupled to the support structure on a second opposite side of the first longitudinal axis, wherein the first and second C-shaped members have ends coupled to one another and pivotally supporting the second carrier.

32. The mixer of claim 24 wherein the first carrier and the second carrier concentrically extend about the first longitudinal axis.

33. The mixer of claim 24 wherein the support structure supports the first carrier and the second carrier about the first longitudinal axis.

* * * * *